United States Patent [19]

Miller

[11] 3,984,000

[45] Oct. 5, 1976

[54] PELLET DISPENSER

[75] Inventor: Neil W. Miller, New Britain, Pa.

[73] Assignee: Merck & Co., Inc., Rahway, N.J.

[22] Filed: Dec. 27, 1974

[21] Appl. No.: 534,763

[52] U.S. Cl. ..... 206/531; 138/128; 206/443; 206/536; 221/307

[51] Int. Cl.[2] ..... B65D 83/04; B65D 85/42

[58] Field of Search ..... 221/303, 307, 309, 310; 138/110, 128; 206/528, 531, 534.2, 535, 536, 443, 804, 394

[56] References Cited

UNITED STATES PATENTS

| | | | |
|---|---|---|---|
| 1,782,526 | 11/1930 | Beardsley | 206/534.1 |
| 1,999,879 | 4/1935 | Lee | 206/445 |
| 2,371,667 | 3/1945 | Arena et al. | 206/528 |
| 3,147,857 | 9/1964 | Eckles | 206/445 |
| 3,162,301 | 12/1964 | Cage, Jr. | 206/535 |
| 3,207,212 | 9/1965 | Carlson et al. | 206/531 |
| 3,284,025 | 11/1966 | Fridolph | 206/394 |
| 3,716,133 | 2/1973 | Koebler et al. | 206/535 |
| 3,768,636 | 10/1973 | O'Connell, Jr. | 206/535 |
| 3,924,661 | 12/1975 | Bornhoffer | 138/110 |

*Primary Examiner*—William Price
*Assistant Examiner*—Bruce H. Bernstein
*Attorney, Agent, or Firm*—Donald J. Perrella; Francis H. Deef; Westlake, Jr. Harry E.

[57] ABSTRACT

A dispensing and packaging system for pellets such as ampules or vials. The system comprises an elongated resilient plastic tube in which the pellets are arranged in a line. The tube is of slightly smaller inner diameter than the pellets; and it is slit along its length so that it expands circumferentially to accomodate the pellets. The plastic material of the tube is sufficiently flexible and resilient at room temperatures to neck down in regions between adjacent pellets or in regions of the pellets which are of small diameter. This necking down provides restraint against axial movement of the pellets to hold them securely in the tube while allowing them to be dispensed individually with a minimum of difficulty.

5 Claims, 5 Drawing Figures

10
12
14
16
17
18
22
24
26
28
A
B

PELLET DISPENSER

BACKGROUND OF THE INVENTION

1. Field of the Invention

This invention relates generally to packaging systems, and more particularly it concerns a novel dispenser type packaging system in which pellet-like elements such as vials, ampules and the like are held in a secure though easily dispensable manner.

2. Description of the Prior Art

In many instances, particularly in agricultural applications, liquid medications must be shipped and stored at extremely low temperatures, e.g., −140°F. (−95°C.), in order to preserve their effectiveness. This is usually accomplished by packaging the medication in ampules and placing a number of these ampules, one above the other, in a metal rack. Examples of such racks are disclosed in U.S. Pat. Nos. 3,130,836 and 3,207,212. These racks are formed of sheet metal strips with wings or tabs which are bent around to partially encircle the larger diameter portion of the ampules. The tabs are resilient and hold the ampules in place by resilient forces. Also, in order to prevent the ampules from slipping longitudinally in the racks, the racks are formed with tabs which are bent inwardly between adjacent ampules.

A characteristic of these prior art racks is that a substantial portion of each of the ampules is left exposed. Thus, when a number of such racks are stored and transported proximate one another, e.g., in a cryogenic tank, each rack must be enveloped within a protective cardboard tube to prevent breakage of ampules on adjacent racks.

Ampules are dispensed from these prior art racks by forcing them out against the spring retention of the wings or tabs. Often, these ampules are formed with narrow, frangible necks, and the dispensing forces are applied beyond the neck. This concentrates stresses in the ampule neck and causes a danger of possible premature breakage of the ampule. In addition a considerable degree of dexterity is required to remove the ampules without breaking them. These difficulties are compounded by the fact that the ampules are maintained at extremely low temperatures so that they are usually manipulated by persons wearing cryogenic protective gloves.

Further, when an ampule carrier is removed from a cryogenic tank, there may exist deposits of frost which envelop the exposed surfaces of both the rack and the ampules carried by it. These frost deposits further impede ampule removal and increase the danger of breakage because of the excessive transverse forces which must be applied to remove the ampule.

SUMMARY OF THE INVENTION

The present invention overcomes the above described difficulties of the prior art and provides a packaging system wherein pellets such as vials or ampules are held in a manner such that they may be maintained safely and securely in a cryogenic environment and yet may be handled and dispensed with ease. With the present invention, the pellets are held so that they only minimally touch each other, and are not subject to abrasion and breakage.

According to the present invention there is provided a pellet dispensing and packaging system comprising, in a novel arrangement, a flexible, resilient tubular element and a plurality of pellets contained therein along its length. The tubular element has a slit extending along its length and at least a protion of the cross section of each pellet is slightly greater than the normal unstressed inner diameter of the tubular element. Therefore, the element opens at the slit in the region of the larger diameter pellet cross sections. This permits the tubular element to squeeze resiliently on the pellets. Additionally, the material of the tubular element is sufficiently flexible and resilient at room temperature, i.e. non-cryogenic temperatures, to neck down in regions between the larger cross sectional portions of adjacent pellets so that the pellets are restrained from longitudinal movement. When the element is thereafter subjected to cryogenic temperatures, it stiffens so that its necked down regions positively hold the pellets against longitudinal movement. The pellets may thereafter be removed by inserting the thumb in the slit and forcing the pellets longitudinally along the element.

There has thus been outlined rather broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis of the designing of other structures for carrying out the purposes of this invention. It is important, therefore, that this disclosure be regareded as including such equivalent constructions as do not depart from the spirit and scope of the invention.

BRIEF DESCRIPTION OF THE DRAWINGS

One embodiment of the invention has been chosen for the purposes of illustration and description, and is shown in the accompanying drawings forming a part of the specification, wherein.

DESCRIPTION OF THE PREFERRED EMBODIMENT

Figures 1, 2, 3, 4, 5:
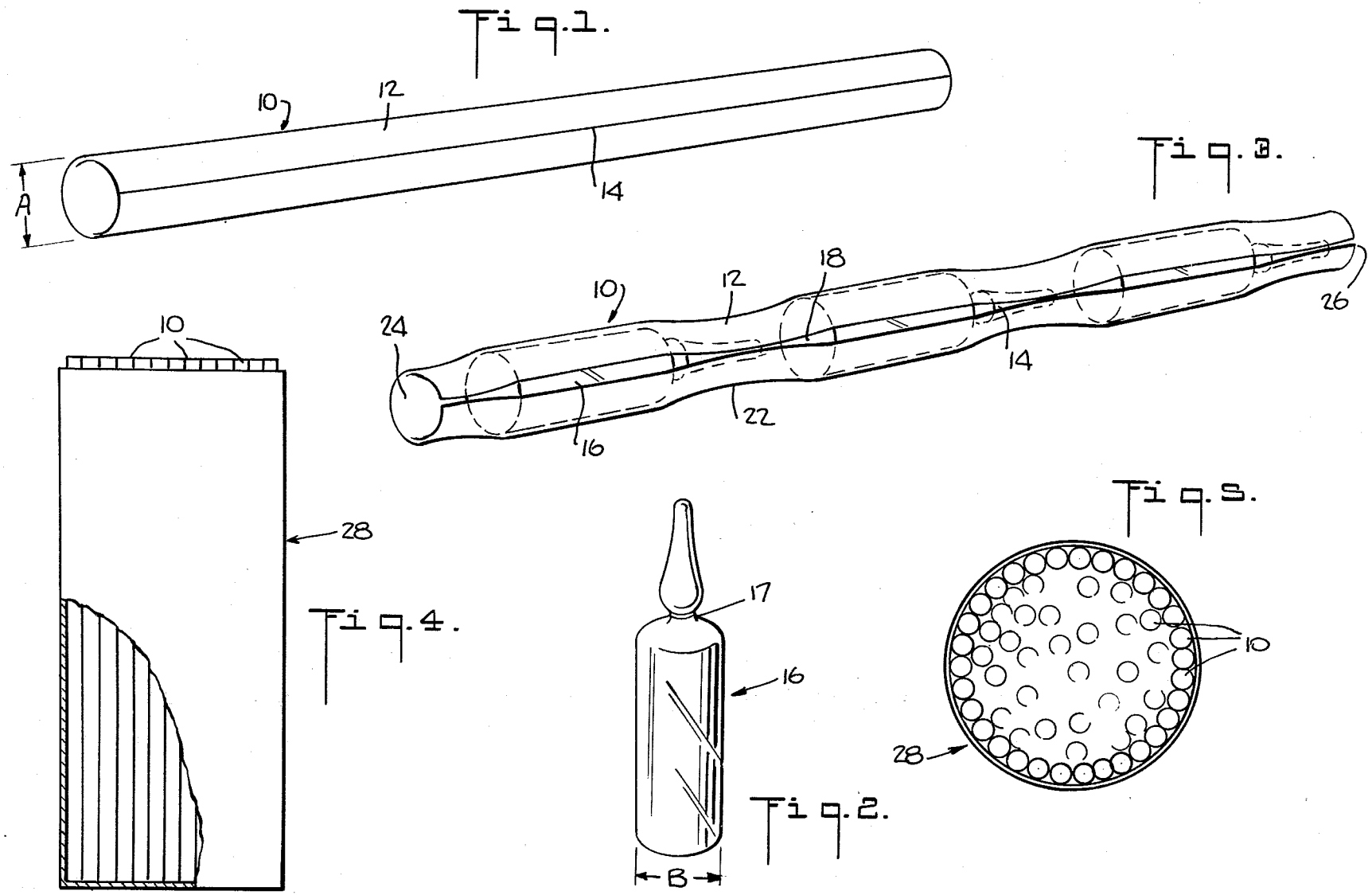
FIG. 1 is a perspective view of a tubular element forming one portion of a pellet dispensing system according to the present invention.
FIG. 2 is a perspective view of an ampule which may be loaded into the element shown in FIG. 1.
FIG. 3 is a perspective view of a fully loaded pellet dispensing system in which the present invention is embodied.
FIGS. 4 and 5 are elevation and top views, respectively, of a plurality of the pellet dispensers shown in FIG. 3 within a container for transportation or storage of the pellets and the material contained therein.

FIG. 1 shows a pellet dispenser 10 comprising an elongated tubular element 12 of a resilient polymeric material. This tubular element is formed with a longitudinal slit 14 extending along its length. As will be appreciated from the following description, the tubular element 12 has sufficient stiffness and strength to be self supporting and to contain pellets within it, and yet it is sufficiently soft and resilient to accomodate and hold pellets of larger cross section than the unslit inner diameter of the element. The material of the tubular element 12 is also substantially unaffected by cryogenic environments. This material is preferably a low density polyetheylene, although nylon, polypropylene, or polytetraflurolethelyene are also useable. In the illustrated embodiment, the tubular element has a length of 7.5 inches (190.50mm.), a normal unstressed inner diameter "A" of ⅜ inches (9.53mm.) and a wall thickness of 0.020 inches (0.51mm.).

FIG. 2 shows an ampule 16 which is carried in the tubular element 12. The ampule 16 is made of glass; and it contains a medicine or other liquid preparation which is completely sealed therein. The medicine or liquid preparation is dispensed from the ampule 16 by breaking the ampule at a small diameter neck 17 near one end thereof. In the present embodiment, the main portion of the ampule 16 has a maximum diameter "B" of 7/16 inches (11.10mm.), which is slightly greater than the diameter "A" of the tubular element 12.

FIG. 3 shows a package 10 comprising a tubular element 12 having three ampules 16 loaded therein. The tubular element 12 expands circumferentially to accomodate the main portions of the ampules 16 which have a slightly greater diameter than the normal unstressed inner diameter of the element 12. The element 12 substantially encircles the ampules 16 and thereby protects them; however, because of the difference in diameters "A" and "B", an axial gap 18 is produced along the slit 14 of the element 12. It will be noted that the gap 18 is larger in those regions occupied by the larger diameter portions of the ampules 16, and that the gap 18 is smaller in the intermediate regions. This is due to a "necking down" of the element 12 in regions 22 thereof, intermediate the larger diameter regions of the ampules 16.

The necking down of the tubular element 12, in regions between the larger diameter portions of adjacent ampules 16, results from the softness and high resiliency and flexibility of the material of the tubular element. This necking down is an important feature of the invention because it serves to restrain the ampules from longitudinal movement during shipment under cryogenic conditions, and yet it permits the ampules to be forced longitudinally out of the element 12 when they are to be dispensed. This may be accomplished simply by inserting the thumb into the gap 18 and pushing against the end of the ampules. During shipment under cryogenic conditions, the tubular element 16 stiffens so that the necked down regions act as positive barriers resisting longitudinal movement of the ampules. However, when the thumb is inserted into the gap 18, the element 12 becomes spread circumferentially so that the ampules are freed for longitudinal movement and dispensing out from the end of the device.

Referring again to FIG. 3, the element 12 is loaded by inserting the ampules 16 through one end 24 of the tube. Each successively loaded ampule 16 will then advance those ampules already loaded toward the opposite end 26. After the desired number of ampules are loaded, they may be spaced a predetermined distance apart from each other.

The loading operation is usually carried out at temperatures much higher than cryogenic, so that the material of the tubular element 12 is sufficiently soft and flexible to neck down in the regions between adjacent ampules. Thereafter, as pointed out above, when the loaded tubular element 12 is subjected to cryogenic conditions the necked down regions become stiff and prevent longitudinal movement of the ampules during storage and shipment.

The ampules 16 are dispensed from the element 12 by sliding them out through the end opening 26. This operation is performed by exerting thumb pressure on them, through the gap 18, directed toward the end opening 26.

Referring now to FIGS. 4 and 5, it will be seen that a plurality of the packages 10 are immersed in a cryogenic tank 28. Because the element 12 protectively covers substantially more than one-half of the surface area of the ampule 16, the need for additional protection in the form of a tubular paper envelope is obviated. Thus, a great number of dispensers 10 may be carried safely in the tank 28.

Although a particular embodiment of the invention is herein disclosed for purposes of explanation, various modifications thereof, after study of this specification, will be apparent to those skilled in the art to which the invention pertains. It is therefore to be understood that, within the scope of the appended claims, the invention may be practiced otherwise than as specifically described herein.

What is claimed and desired to be secured by letters patent is:

1. A pellet dispensing and packaging system comprising a tubular element having a substantial degree of flexibility and resilience at room temperatures and having a longitudingal slit extending therealong and a plurality of pellets aligned inside said tubular element, each of said pellets having a maximum diameter region slightly larger than the normal unstressed inner diameter of said tubular element to maintain its longitudinal slit open in the vicinity of each larger diameter portion, said maximum diameter regions of adjacent pellets being longitudinally separated from each other, the material of said element being sufficiently flexible and resilient at room temperatures to neck down in regions thereof between said maximum diameter regions of said pellets, whereby said pellets are resiliently unstrained from longitudinal movement within said element.

2. A pellet dispensing and packaging system according to claim 1 wherein said tubular element stiffens at cryogenic temperatures.

3. A pellet dispensing and packaging system according to claim 1 wherein said pellets have a larger diameter region extending along one portion of their lengths and a smaller diameter region extending along another portion of their lengths.

4. A pellet dispensing and packaging system according to claim 1 wherein said element necks down at at least one of its two ends.

5. A pellet dispensing and packaging system according to claim 1 wherein said element extends over the major portion of the outer surface of said pellets at said maximum diameter regions of said pellets.

* * * * *